United States Patent [19]

Karrenbauer

[11] Patent Number: 4,475,017

[45] Date of Patent: Oct. 2, 1984

[54] AUTOPNEUMATIC COMPRESSED GAS SWITCH

[75] Inventor: Herbert Karrenbauer, Niestetal, Fed. Rep. of Germany

[73] Assignee: Licentia-Patent-Verwaltungs-GmbH, Fed. Rep. of Germany

[21] Appl. No.: 403,529

[22] Filed: Jul. 30, 1982

[30] Foreign Application Priority Data

Aug. 17, 1981 [DE] Fed. Rep. of Germany ..... 3132305

[51] Int. Cl.[3] ..... H01H 33/88

[52] U.S. Cl. ..... 200/148 A

[58] Field of Search ..... 200/148 A, 148 R, 150 G

[56] References Cited

U.S. PATENT DOCUMENTS 3,098,915 7/1963 Chabala ..... 200/148 A

*Primary Examiner*—Robert S. Macon

*Attorney, Agent, or Firm*—McGlew and Tuttle

[57] ABSTRACT

An autopneumatic compressed gas switch comprises a gas cylinder with a piston which is cooperable with the cylinder and with one of them being movable relative to the other with changes of gas pressure. The stationary tubular part having one wall with an axially extending slot is disposed adjacent the cylinder and piston combination. A counter contact is disposed in the stationary tubular part and it has a radial projection which extends through the slot of the stationary part. An insulating bushing is connected to the movable one of the piston and cylinder set and is movable therewith. The insulating bushing carries a contact piece which is engageable with the counter contact. A releasable latch is connected between the bushing which has the contact piece and the counter contact so that the two parts move together. The spring is provided between the first projection of the counter contact and the stationary tubular part in a spring system arranged to exert a biasing force during contact breaking to release the latch which effects the connection between the bushing and the counter contact, and to move the contact until the projection thereof goes to the end of the slot.

8 Claims, 5 Drawing Figures

AUTOPNEUMATIC COMPRESSED GAS SWITCH

FIELD AND BACKGROUND OF THE INVENTION

This invention relates in general to actuating switches and in particular to a new and useful switch particularly for compressed gases in which during contact breaking the two switch parts are maintained in contact for a period of time and then the separation is effected with a driving separation which forces one of the parts to an end position.

The invention relates to an autopneumatic compressed gas switch having a piston-cylinder unit as a compression system for the quenching gas, a first contact piece and an insulating bushing surrounding the latter, which are firmly connected with the movable part of the piston-cylinder unit, and a second (counter-) contact piece which upon breaking contact is at first held in engagement with the first contact piece and follows it and then runs back under spring force.

A similar compressed gas switch is known from German OS No. 29 18 145. In this compressed gas switch the second (counter-) contact piece is connected or latched directly with the first contact piece. A disadvantage in this solution is that the latch connection is arranged in a region in which the switching arc burns. It is therefore almost inevitable that the arc will impair the locking mechanism.

SUMMARY OF THE INVENTION

The invention provides an autopneumatic compressed gas switch in which the locking mechanism is removed from the action of the switching arc.

According to the invention a second (counter-) contact piece is connected with a movable part of a piston-cylinder unit directly and releasably via an insulating intermediate piece. In this way the locking mechanism can be arranged in a region which is not affected by the switching arc. Thereby impairment by the arc is avoided and a satisfactory operation independent of the mode and number of the cutoffs is ensured.

A development of the invention provides that the release of the second (counter-) contact piece occurs as a function of the force of a spring. In this solution the contact breaking occurs at high relative speed of the two contact pieces to each other. This has a favorable effect on the quenching of short circuit currents and the interruption of capacitive currents. The spring which brings about the release of the second (counter-) contact piece is advantageously a spring which moves the second contact piece back to its starting position, or it may be a spring provided additionally.

A further development of the invention provides that, in addition to the spring which causes the return, a stop is provided. This stop may be formed to act as a spring or to have a damping effect. Expediently it is provided that for the entrainment of the second contact piece a mechanical latch connection is provided between the insulating intermediate piece and this contact piece. To this end the second contact piece comprises, according to an advantageous realization, a radial projection which engages in a recess of the insulating intermediate piece.

According to another realization of the invention, the second (counter-) contact piece is arranged slidable in a stationary tubular structural part. In this case the structural element expediently comprises at least one axis-parallel slot, through which the radial projection engages outward into the recess of the insulating intermediate piece. In a very advantageous manner the insulating intermediate bushing may alternatively form a unit.

Another advantageous realization provides that the latch connection of the second contact piece and of the insulating intermediate piece is releasable as a function of the stroke of the piston-cylinder unit.

Accordingly, it is an object of the invention to provide an automatic pneumatic compressed gas switch which comprises a gas cylinder with a piston therein which cooperates so that one of the two moves apart during changes of gas pressure and which are arranged alongside a stationary tubular part which has one wall in an axially extending slot and with a counter contact therein with a radial projection which extends through and is confined for movement along the slot and wherein an insulating bushing is connected to the movable one of the piston and cylinder combinations which has a contact piece which is engageable with the counter contact, the arrangement including releasable latch connecting the counter contact with the bushing having the contact piece and which further includes a spring acting between the radial projection of the counter contact and the stationary tubular member which increases in biasing force during contact breaking to subsequently release the latching connection between the bushing and the counter contact and to drive the counter contact back to an end position.

A further object of the invention is to provide a compressed gas switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
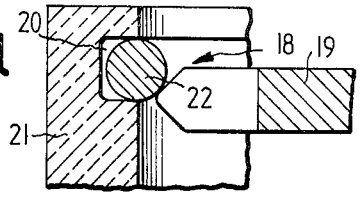
FIG. 1*a* is an enlarged detailed view of the latching mechanism indicated in FIG. 1.

Referring to the drawings in particular the invention embodied therein comprises an autopneumatic compressed gas switch which comprises a gas compression system 2 in which there is a stationary piston 2*a* with a movable cylinder 2*b* which cooperates therewith. An also stationary tubular part 10 has a wall with at least one axially extending slot 24 in which are engageable one or more radial projections 19 of a counter contact 8 which is disposed within the stationary tubular part 10. An insulating bushing 4 is connected to the movable part 2*b* and it has a contact piece 6*a* which is engageable with the counter contact piece 8. Releasable latch means 18 interconnect the counter contact part 8 with the insulating bushing 4 so that the contact piece 6*a* moves along on the contact piece 8 but during contact breaking the spring system including springs 14 and 15 disposed between their radial projection 19 and a flange or inwardly projecting portion 11 of the stationary tubular part 10 affects the releasing of the latch 18 to cause the radial projection 19 of the counter contact to run along the slot 24 to the end thereof which forms a fixed stop.

With respect to its contact system, the autopneumatic compressed gas switch illustrated in the drawing comprises essentially the following parts:

A compression system 2, which consists of a stationary piston 2*a* and a movable cylinder 2*b;*

An insulating bushing 4 disposed on the cylinder 2*b;*

A contact piece 6*a* disposed in the insulating bushing 4 and movable therewith;

A counter-contact piece 8 which is arranged axially displaceable in the upper portion of the switch 10;

A stop 12 as well as two compression springs 14,15;

A current contact 16 as well as a latch connection 18.

The movable contact piece 6*a* and the insulating bushing 4 are connected with the movable cylinder 2*b*. The counter-contact piece 8 is formed as a movable pin which is arranged axially slidable in stationary tubular part 10. This tubular part 10 has inwardly protruding flange 11, in which the annular current contact 16 is disposed. The flange 11 also forms an abutment for the two compression springs 14 and 15, the other end of one spring taking support against radial projections 19 of the counter-contact piece 8 which are a component part of the latch connection 18. The other end of the first compression spring 14 is arranged spaced from the radial projections 19.

The latch connection 18 consists of the radially outward pointing projections 19 and of an elastic ring 22 which engages in a recess 20 provided on the inner side of the insulating intermediate piece 21.

Figure 1:
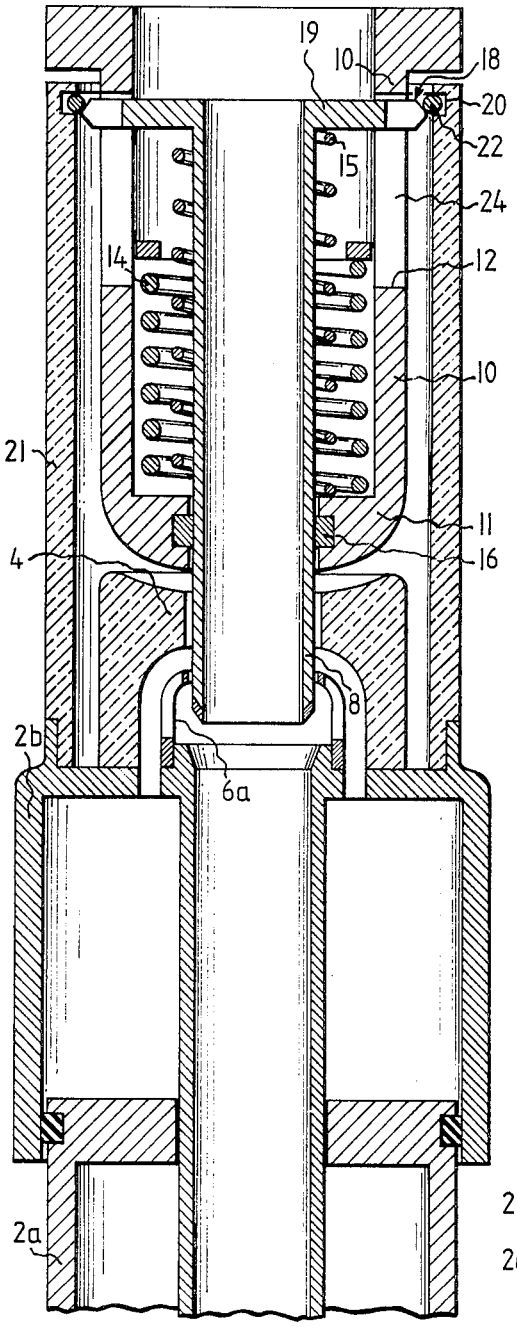
FIG. 1 is an axial sectional view of an autopneumatic compressed gas switch constructed in accordance with the invention.

In the contact making position (FIGS. 1 and 3) the counter-contact piece 8 is latched with the insulating intermediate piece 21 via the projections 19. Because of this latch connection, the counter-contact piece 8 is taken along by the insulating bushing 4 at the start of the contact breaking movement and thus follows the movement of the cylinder 2*b*. A relative movement between the counter-contact piece 8 and the movable contact piece 6*a* thus does not take place.

Figure 2:
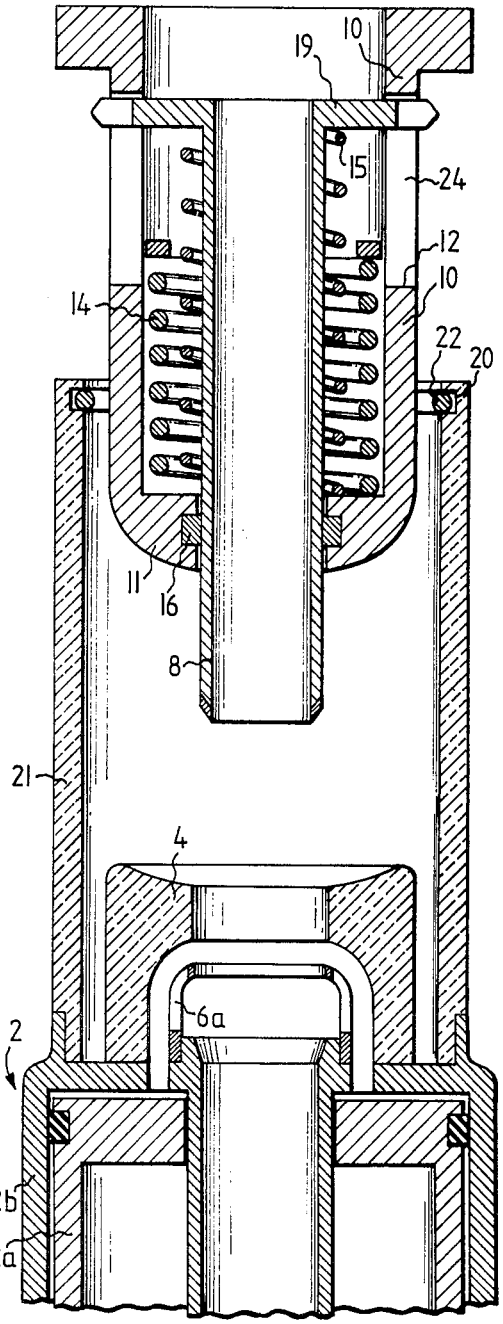
FIG. 2 is a view similar to FIG. 1 with the switch in an open position.

During the movement of the counter-contact piece 8, first the return spring 15 and after a certain stroke the compression spring 14 are tensioned. At a defined tension of the compression spring 14, the ring 22 is deformed by the two radial projections 19 to such an extent that it slips off over these projections 19. Under the action of the compression spring 15 and the compression spring 14 now operative additionally, the counter-contact piece is then greatly decelerated and subsequently accelerated in the opposite direction. Contact breaking is then effected at high relative speed of the two contact pieces to each other (FIGS. 2 and 4).

In addition to the spring force causing the contact breaking, a fixed stop 12 may be provided, at which the counter-contact piece 8 comes to a final standstill. The stop 12 is formed by the end of axis-parallel slots 24 in the tubular part 10, through which slots the radial projections 19 protrude to the outside. During contact making a new latch connection takes place due to the slipping through of the radial projection 19 through ring 22.

Figure 3:
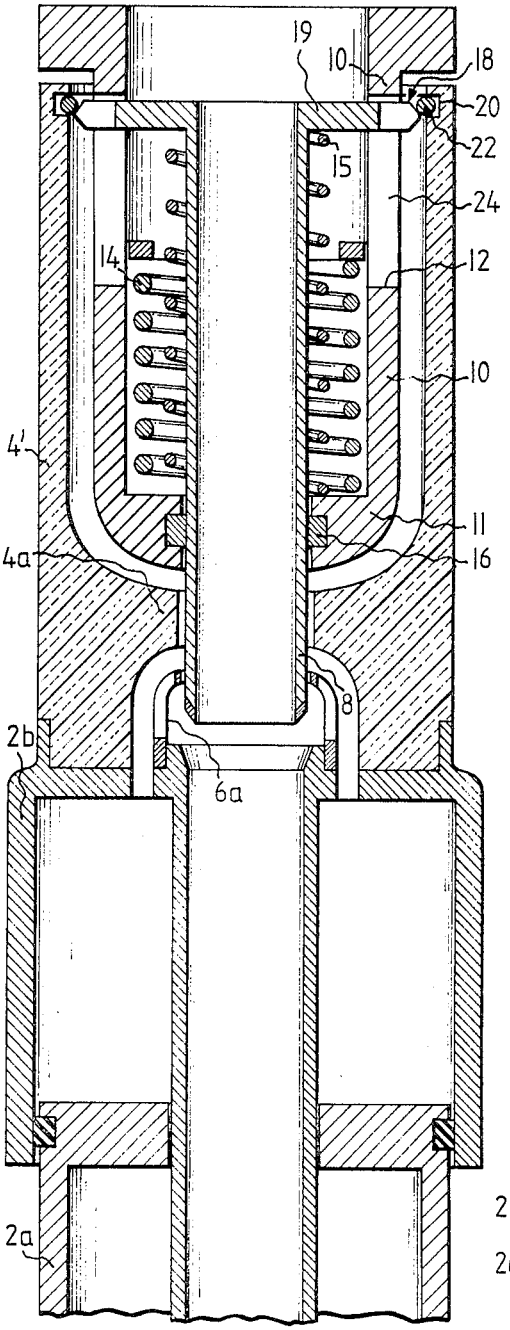
FIG. 3 is a view similar to FIG. 1 of another embodiment of the invention.
Figure 4:
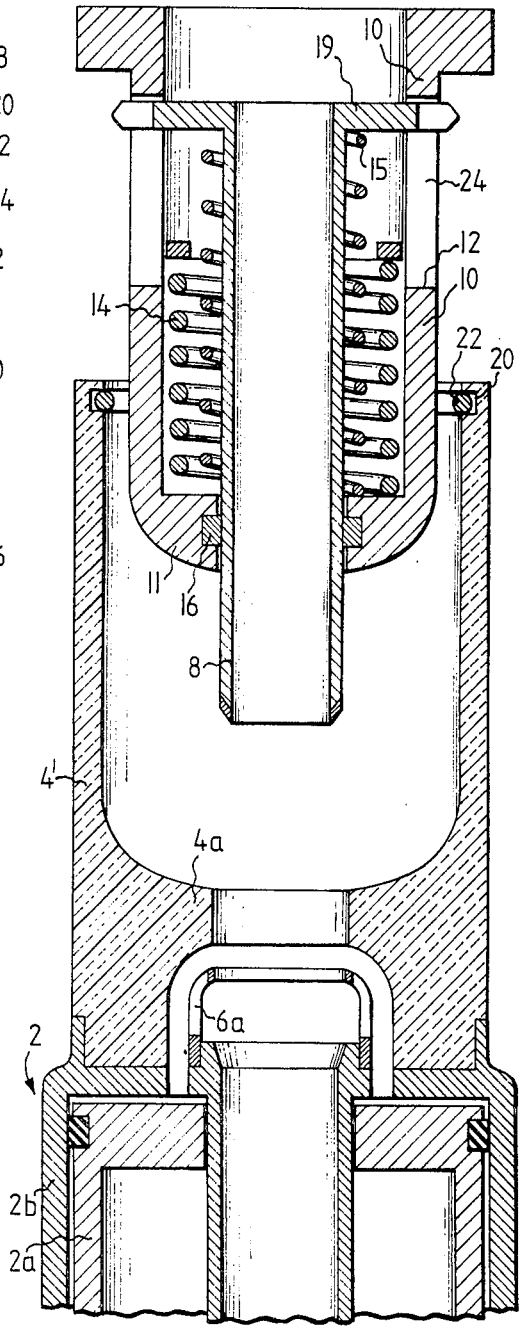
FIG. 4 is a view similar to FIG. 2 showing the switch of FIG. 3 in an open position.

In the embodiment of the invention shown in FIGS. 3 and 4, the parts are similarly designated but the insulating bushing is designated 4′ and it comprises a single tubular bushing having an inwardly projecting portion 4*a* which is guided on the counter contact 8.

While specific embodiments of the invention have been shown and described in detail to illustrate the application of the principles of the invention, it will be understood that the invention may be embodied otherwise without departing from such principles.

What is claimed is:

1. An autopneumatic compressed gas switch, comprising a gas cylinder, a piston cooperable with said cylinder, said piston and said cylinder being relatively movable to compress a gas therebetween, a stationary tubular part having one wall with an axially extending slot, a counter contact disposed in said stationary tubular part and having a radial projection extending through said slot, an insulating bushing connected to the movable one of said piston and cylinder and movable therewith and having a contact piece engageable with said counter contact, releasable latch means for releasably connecting said insulating bushing to said counter contact, and spring means disposed between said counter contact and said stationary tubular part for increasing in biasing force during the relative movement of said piston and cylinder to effect release of said latch means and said counter contact from said insulating bushing and to move said counter contact to an end position thereof.

2. A switch according to claim 1 wherein said spring means comprises a spring system acting to move said counter contact back to an initial position, said radially extending projection moving during release to an end position in said slot.

3. A switch according to claim 1 wherein said piston is stationary, said cylinder being movable relative to said piston.

4. A switch according to claim 1 wherein said latch includes said radial projection of said counter contact, said insulation bushing including an outer sleeve portion having a recess, a resilient ring disposed in said recess and projecting outwardly therefrom and engageable with said projection, said projection being movable passed said ring on the exertion of a predetermined force by said spring means.

5. A switch according to claim 1, wherein the end of said slot of said stationary tubular part comprises a stop acting on said counter contact to said radial projection.

6. A switch according to claim 1, wherein said counter contact comprises a tubular member having a plurality of radial projections, said stationary part having a slot for each projection, the outer ends of said radial projections defining a latch part, said insulating bushing having an outer sleeve portion movable with said movable cylinder with a ring engageable with said projections comprising said latch.

7. A switch according to claim 1, wherein said insulating bushing includes a cylindrical sleeve member having an inwardly formed bushing portion fixed to said compression cylinder, said cylinder being movable relative to said piston, said contact piece being carried at the end of said cylinder and engaged with said counter contact, and including a current contact carried by said stationary tubular part in the form of a ring engaging the periphery of a central tubular portion of said counter contact.

8. A switch according to claim 1, wherein said spring means comprises first and second springs of different compressor force, said latch being disconnectable in accordance with the stroke of said piston and cylinder unit.

* * * * *